US009482153B2

(12) United States Patent
Bethel et al.

(10) Patent No.: US 9,482,153 B2
(45) Date of Patent: Nov. 1, 2016

(54) OIL RETENTION IN THE BORE/PISTON INTERFACES OF PORTED CYLINDERS IN OPPOSED-PISTON ENGINES

(75) Inventors: Steven J. Bethel, Chassell, MI (US); Brian J. Callahan, San Diego, CA (US); Bryant A. Wagner, San Diego, CA (US)

(73) Assignee: ACHATES POWER, INC., San Diego, CA (US)

( * ) Notice: Subject to any disclaimer, the term of this patent is extended or adjusted under 35 U.S.C. 154(b) by 1172 days.

(21) Appl. No.: 12/931,199

(22) Filed: Jan. 26, 2011

(65) Prior Publication Data

US 2012/0186561 A1 Jul. 26, 2012

(51) Int. Cl.

| | |
|---|---|
| ***F02B 75/28*** | (2006.01) |
| ***F01M 9/00*** | (2006.01) |
| ***F02F 1/18*** | (2006.01) |
| ***F02F 1/20*** | (2006.01) |
| ***F02F 3/02*** | (2006.01) |

(52) U.S. Cl.

CPC ..... *F02B 75/282* (2013.01); *F02F 1/186* (2013.01); *F02F 1/20* (2013.01); *F02F 3/027* (2013.01)

(58) Field of Classification Search

CPC ..... F02B 75/28; F02F 1/186; F02F 3/00; F02F 3/28; F02F 5/00; F02F 1/20; F02F 3/225

USPC ..... 123/193.1, 196 R, 51 R, 51 B

See application file for complete search history.

(56) References Cited

U.S. PATENT DOCUMENTS

| | | | | |
|---|---|---|---|---|
| 3,398,728 | A * | 8/1968 | Hardman | F01B 9/00 123/193.4 |
| 3,620,137 | A * | 11/1971 | Prasse | F16J 10/04 123/193.2 |
| 3,947,269 | A | 3/1976 | Prasse et al. | 75/170 |
| 4,075,934 | A | 2/1978 | Wacker et al. | 92/159 |
| 4,258,084 | A | 3/1981 | Hayden, Sr. | 427/239 |
| 5,029,562 | A | 7/1991 | Kamo | 123/193 |

(Continued)

FOREIGN PATENT DOCUMENTS

| | | | |
|---|---|---|---|
| GB | 2168457 A | 6/1986 | F16J 1/02 |
| GB | 2171776 A | 9/1986 | F16J 1/08 |
| GB | 2448544 A | 10/2008 | F16J 1/08 |

OTHER PUBLICATIONS

Engineering and Design—Lubricants and Hydraulic Fluids, Publication #: EM 1110-2-1424, Feb. 28, 1999, pp. 6-1 through 6-10.

(Continued)

*Primary Examiner* — Long T Tran

(74) *Attorney, Agent, or Firm* — Terrance A. Meador

(57) ABSTRACT

An opposed piston engine includes at least one cylinder with a bore surface and longitudinally-spaced exhaust and intake ports that open through the sidewall of the cylinder. A pair of opposed pistons is disposed in the cylinder for sliding movement along the bore surface. An oil-retaining surface texture pattern in an interface between the pistons and the bore surface extends in a longitudinal direction of the cylinder, aligned with bridges of at least one port. The surface texture pattern includes a plurality of separate recesses on an outside surface of a skirt of each piston. Alternatively, or in addition, the surface texture pattern includes a plurality of separate recesses extending in a longitudinal direction of the cylinder, aligned with bridges of at least one port.

19 Claims, 11 Drawing Sheets

(56) References Cited

U.S. PATENT DOCUMENTS

| | | | | |
|---|---|---|---|---|
| 5,408,964 | A | 4/1995 | Rao | 123/193 |
| 5,582,144 | A | 12/1996 | Mizutani | 123/193.2 |
| 6,095,690 | A | 8/2000 | Niegel et al. | 384/293 |
| 6,197,370 | B1 | 3/2001 | Rao et al. | 427/236 |
| 6,253,724 | B1 | 7/2001 | Han | 123/193.2 |
| 6,976,419 | B1 | 12/2005 | Miyamoto et al. | 92/153 |
| 7,104,240 | B1 | 9/2006 | Vuk | 123/193.2 |
| 7,106,941 | B2 * | 9/2006 | Matano et al. | 385/147 |
| 7,171,936 | B2 * | 2/2007 | Rein | C23C 4/16 123/193.4 |
| 7,406,941 | B2 * | 8/2008 | Zhu | F02F 3/0084 123/193.6 |
| 7,415,961 | B1 * | 8/2008 | Chen | F16J 1/08 123/193.6 |
| 2004/0099228 | A1 * | 5/2004 | Roberts | F01B 9/026 123/55.7 |
| 2005/0087166 | A1 * | 4/2005 | Rein | C23C 4/16 123/193.4 |
| 2006/0213466 | A1 * | 9/2006 | Hofbauer | F02B 1/12 123/46 R |
| 2007/0000468 | A1 | 1/2007 | Azevedo et al. | 123/193.4 |
| 2008/0041346 | A1 * | 2/2008 | Hofbauer | F01M 1/12 123/51 BC |
| 2009/0090325 | A1 * | 4/2009 | Shi | F02F 1/20 123/193.4 |

OTHER PUBLICATIONS

Van de Velde, et al, "The friction force during stick-slip with velocity reversal", WEAR, V. 216, I. 2, Apr. 1998, pp. 138-149.

* cited by examiner

OIL RETENTION IN THE BORE/PISTON INTERFACES OF PORTED CYLINDERS IN OPPOSED-PISTON ENGINES

BACKGROUND

The field is internal combustion engines. Particularly, the field includes opposed-piston engines. In more particular applications, the field relates to a ported cylinder equipped with opposed pistons in which the bore and/or piston surfaces are constructed so as to promote lubrication of the bore/piston surface interfaces. Such constructions for a ported cylinder include the provision of an oil-retaining surface texture in an interface between opposed pistons disposed in the cylinder and the cylinder's bore. The oil-retaining texture includes one or more patterns of separate recesses that extend in a longitudinal direction of the cylinder, aligned with bridges of at least one of the cylinder's ports.

A "ported" internal combustion engine is an internal combustion engine having at least one cylinder with one or more ports through its side wall for the passage of gasses into and/or out of the bore of the cylinder. Relatedly, such .a cylinder is a "ported cylinder."

When compared with four-stroke engines, two-stroke, opposed-piston engines have acknowledged advantages of specific output, power density, and power-to-weight ratio. For these and other reasons, after almost a century of limited use, increasing attention is being given to the utilization of opposed-piston engines in a wide variety of modern transportation applications.

A representative opposed-piston engine is illustrated in FIGS. 1 and 2. The opposed-piston engine includes one or more cylinders 10, each with a bore 12 and longitudinally-displaced exhaust and intake ports 14 and 16 machined or formed therein. Each of one or more fuel injector nozzles 17 is located in a respective injector drilling that opens through the side of the cylinder, at or near the longitudinal center of the cylinder. Two pistons 20, 22 are disposed in the bore 12 with their end surfaces 20*e*, 22*e* in opposition to each other. For convenience, the piston 20 is referred as the "exhaust" piston because of its proximity to the exhaust port 14; and, the end of the cylinder wherein the exhaust port is formed is referred to as the "exhaust end". Similarly, the piston 22 is referred as the "intake" piston because of its proximity to the intake port 16, and the corresponding end of the cylinder is the "intake end". One or more rings 23 are mounted in circumferential grooves formed in each of the pistons 20, 22 near the piston's crown. When used herein, the term "ring" denotes a conventional piston ring and/or an annular, low-tension compression seal.

The exhaust and intake ports 14 and 16 of the cylinder 10 seen in FIG. 1 are similarly constructed. Consequently, although only the intake port construction is visible in the figure, the following explanation pertains to the exhaust port as well. As per FIG. 1, the intake port 16 includes at least one sequence of openings 28 through the sidewall and in a peripheral direction of a cylinder 10 near the intake end of the cylinder. For example, the openings 28 extend in a circumferential direction. The openings 28 are separated by bridges 29 (sometimes called "bars"). Relatedly, the term "port" in the description to follow refers to an alternating series of openings and bridges peripherally spaced around the cylinder near one of its ends. In some descriptions the openings themselves are called ports; however, the construction of one or more peripheral sequences of such "ports" is no different than the port constructions shown in the figures to be discussed.

Operation of an opposed-piston engine with one or more cylinders 10 is well understood. With reference to FIG. 2, in response to combustion occurring between the end surfaces 20*e*, 22*e* the opposed pistons move away from respective top dead center (TDC) positions where they are at their closest positions relative to one another in the cylinder. While moving from TDC, the pistons keep their associated ports closed until they approach respective bottom dead center (BDC) positions in which they are furthest apart from each other. In an aspect of opposed-piston engine construction, the exhaust port 14 opens as the exhaust piston 20 moves toward BDC while the intake port 16 is still closed so that exhaust gasses produced by combustion start to flow out of the exhaust port 14. As the pistons continue moving away from each other, the intake port 16 opens while the exhaust port 14 is still open and a charge of pressurized air ("charge air"), with or without recirculated exhaust gas, is forced into the cylinder 10. The charge air entering the cylinder drives exhaust gasses produced by combustion out of the exhaust port 14.

As per FIG. 1, presuming the phase offset mentioned above, the exhaust port 14 closes first, after the pistons reverse direction and begin moving toward TDC. The intake port 16 then closes and the charge air in the cylinder is compressed between the end surfaces 20*e* and 22*e*. As best seen in FIG. 2, as the pistons advance toward their respective TDC locations in the cylinder bore, fuel 40 (typically, but not necessarily, diesel) is injected through nozzles 17 directly into the charge air in the bore 12, between the end surfaces 20*e*, 22*e* of the pistons. The mixture of charge air and fuel is compressed in a combustion chamber 32 defined between the end surfaces 20*e* and 22*e* when the pistons 20 and 22 are near their respective TDC locations. When the mixture reaches an ignition temperature, the fuel ignites in the combustion chamber, driving the pistons apart toward their respective BDC locations.

In order to increase the mechanical effectiveness and durability of an opposed-piston engine, it is desirable to reduce energy loss and wear caused by friction between the cylinder bore and the opposed pistons disposed for sliding movement therein. In the opposed-piston context illustrated in FIGS. 1 and 2, there are three areas in which friction between the bore and the piston rings is most severe: 1) top reversal zones where the pistons reach TDC, 2) bottom reversal zones where the pistons reach BDC, and 3) the port bridges. The reversal zones are those annular sectors of the cylinder bore surface near where the pistons change direction and the reciprocating motion of the rings' sliding velocity is at zero.

When the sliding velocity of the piston rings is low enough, (as when approaching reversal zones), the hydrodynamic pressure of the oil film that keeps the rings and bores separated from each other diminishes. At that point the pressure difference between the inside and peripheral surfaces of the rings due to pressurized gases acting upon the inside face of the rings, the rings' tension, forced radial vibration forces, resonant radial vibration forces, and gravity force or any combination of such forces can induce asperities (roughness of the surfaces) of the rings and the cylinder bores to come into contact. When this happens, friction increases substantially and localized temperatures of the bore surfaces increase. This can result in the material at these locations failing if the strength of the bore's running surface material at a given temperature is exceeded.

Friction during these rough surface contacts is much higher than under conditions of pure hydrodynamic lubrication, (when, by definition, the asperities are not touching). Friction in the reversal zones typically contributes more than half of the total friction, power consumed by the pistons ring groups in spite of the low sliding speeds at these reversal zones. Reducing friction at these reversal zones has a large beneficial effect on overall friction of the ring system, as has been clearly demonstrated and documented in numerous technical papers, (i.e. "The Friction Force During Stick-slip With Velocity Reversal", WEAR, vol. 216, Issue 2, 1 Apr. 1998, 138-149).

Very complex stresses occur during transit of the piston rings across the cylinder port bridges. Reduction of the bore surface area concentrates ring-loading pressure on the interface between the bridges and the ring surface portions that contact the bridges. The surface portions of the rings that pass over the port openings bulge and encounter the edges of the bore surface through which the openings are formed. These and other stresses produce high levels of friction as the rings pass over the ports.

To avoid failure modes and reduce overall friction for a given combination of bore running surface materials and ring running surface materials, asperity contact must be minimized, the coefficient of friction, and the temperature, must be reduced. One strategy to achieve these goals is to ensure that an adequate volume of oil resides in high-friction areas. The balance between pressure forces, viscous forces, oil cavitations, and surface tension forces supplies a net hydrostatic pressure that both reduces asperity contact and reduces friction.

The usual compromise with maintaining a layer of oil on the cylinder bore is that to some extent the oil will evaporate or will be mechanically depleted when exposed to the cylinder gases. This oil is lost either by being consumed in combustion or by being expelled as unburned, or partially burned, hydrocarbon in the exhaust stream, both of which result in undesirable consequences. The evaporation is aggravated as the vapor pressure of each of the oil's constituent fractions increases exponentially with temperature. Therefore, a significant amount of oil lost due to evaporation occurs in the top reversal zone. Mechanical depletion is aggravated when the thickness of the oil film becomes large enough that shearing forces from the sliding solid surfaces of the rings transport it either into the combustion chamber above the top ring or else into the exhaust port past the bottom ring. If oil is transported into the intake port, it may or may not be lost to the combustion chamber depending upon the gas flow conditions. Consequently, considerable attention has been given to the problem of maintaining a distribution of oil in the bore/piston interface, especially in zones of high friction.

One approach for retaining oil in the bore/piston interface is a cylinder bore construction including a surface texture composed of a plurality of indentations formed in the surface of the bore, particularly in the reversal zones. Lubricant retained in the indentations maintains the hydrodynamic film in those zones. For example, U.S. Pat. No. 7,104,240 describes a surface texture composed of a pattern of indentations formed in the bore of a cylinder liner in which a single piston slides on the bore surface between TDC and BDC areas that are located near the ends of the cylinder. In the pattern, the density of indentations varies in a longitudinal direction of the liner such that the density is greater at the longitudinal ends of the liner than in the middle. The density pattern spirals around the bore surface with a pitch that varies from end to end of the liner, in which the pitch is greater in the mid-portion of the liner than at the ends. Consequently, indentations are distributed circumferentially around the circumference of the bore surface, from one end to the other of the liner.

However, the longitudinal density variation of the spiral pattern of indentations in the liner bore for a single piston is unsuitable for the bore of an opposed-piston cylinder for at least two reasons. First, there are four reversal zones for the opposed pistons in the bore of an opposed-piston cylinder, with one BDC reversal zone at each end and two TDC reversal zones near the middle of the bore. Second, a continuous circumferential distribution of lubricant-retaining indentations in a ported cylinder would result in transport of lubricant past the port openings.

SUMMARY

The invention set forth and illustrated in the following detailed description provides a lubrication-retaining surface texture construction for an opposed-piston engine with one or more ported cylinders. The construction includes a surface texture composed of a plurality of separate recesses formed in the piston/bore interface, in patterns that extend in a longitudinal direction of the cylinder, in alignment with bridges of at least one port.

Desirably, the outer surface of each piston skirt includes a surface texture construction with one or more patterns of separate recesses, in which each pattern is aligned with the bridges of the port with which the piston is associated.

Desirably, the surface of the bore of a ported cylinder includes a surface texture construction with one or more patterns of recesses, in which each pattern is aligned with the bridges of a cylinder port.

Desirably, the patterns are provided on the skirt surface of each piston, on the bore surface of the cylinder, or both.

BRIEF DESCRIPTION OF THE DRAWINGS

The below-described drawings are meant to illustrate principles and examples discussed in the following description. They are not necessarily to scale.

DETAILED DESCRIPTION OF THE PREFERRED EMBODIMENTS

Figure 1:
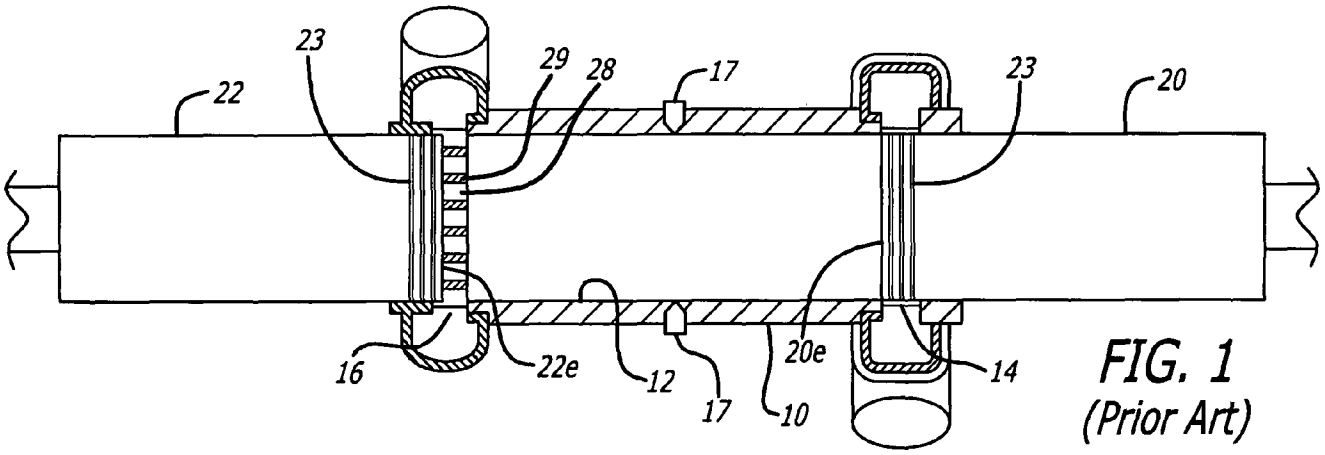
FIG. 1 (Prior Art)
FIG. 1 is a side sectional partially schematic drawing of a cylinder of a prior art opposed-piston engine with opposed pistons near respective bottom dead center locations, and is appropriately labeled "Prior Art".
Figure 2:
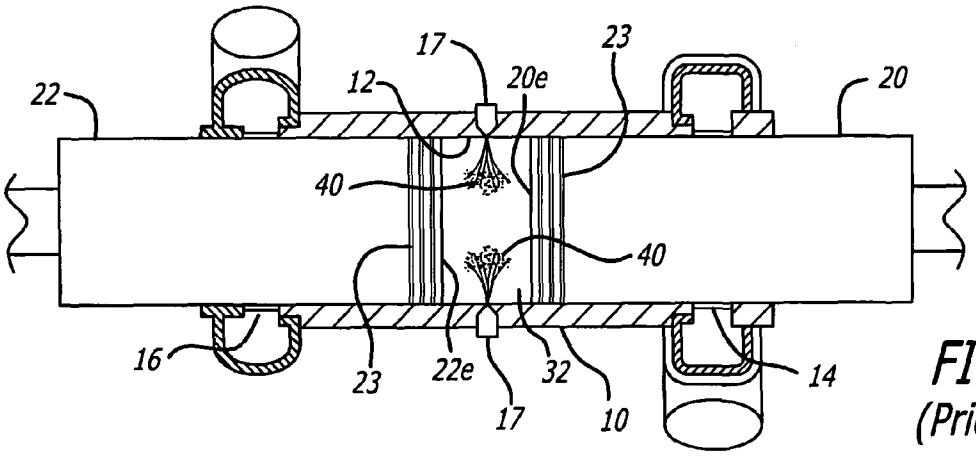
FIG. 2 (Prior Art)
FIG. 2 is a side sectional partially schematic drawing of the cylinder of FIG. 1 with the opposed pistons near respective top dead center locations where end surfaces of the pistons define a combustion chamber, and is appropriately labeled "Prior Art".
Figure 3:
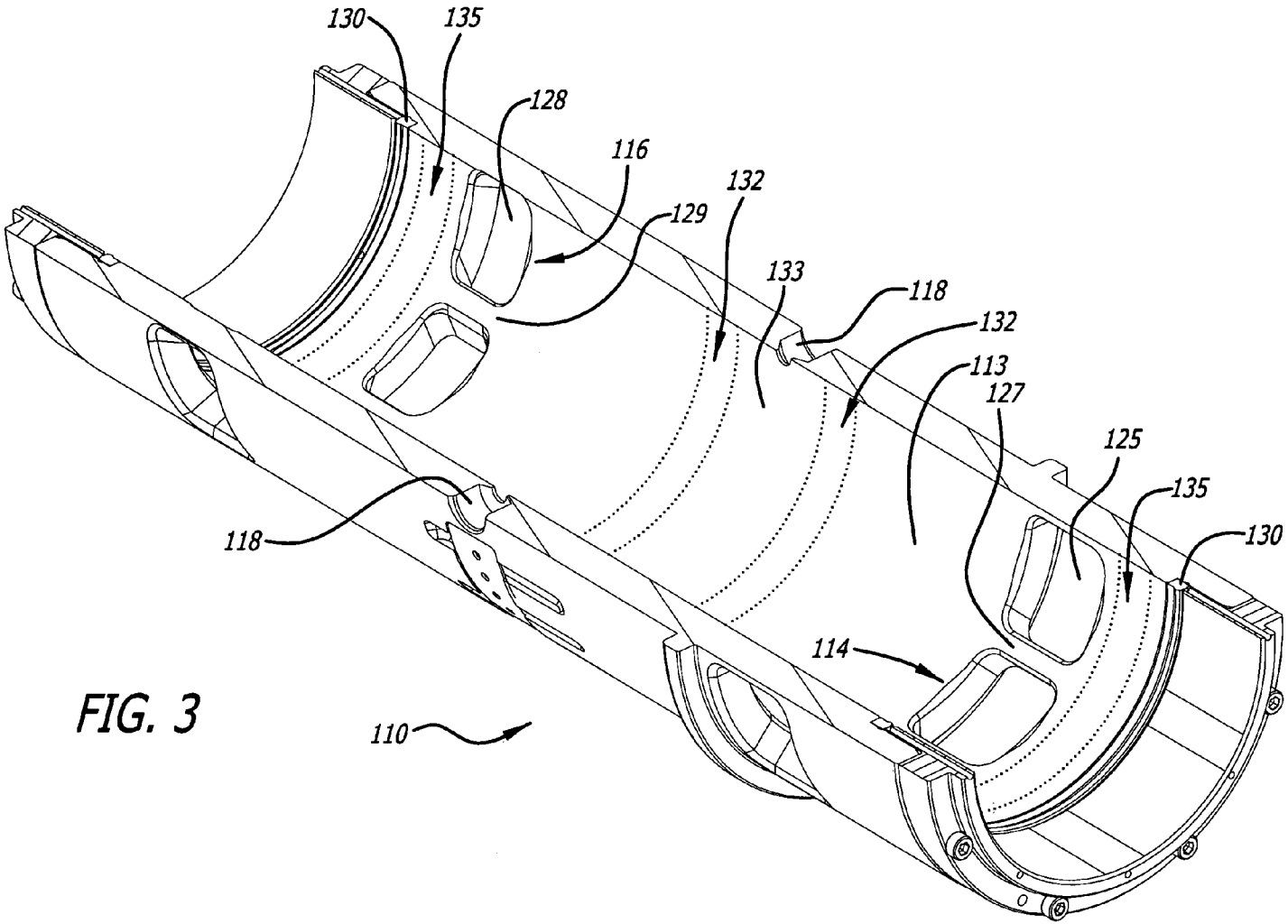
FIG. 3 is a cross sectional perspective view of an opposed piston engine cylinder showing constructions of the exhaust and intake ports.

With reference to FIG. 3, a ported cylinder 110 has an internal surface 113 that defines a bore in which a pair of pistons (not shown) is disposed for slidable movement as illustrated in FIGS. 1 and 2. Exhaust and intake ports 114 and 116 are formed or machined in respective intake and exhaust ends of the cylinder. The exhaust and intake ports 114, 116 are spaced apart in a longitudinal direction of the cylinder, and are positioned near respective ends of the cylinder. Opposed drillings 118 are provided through the cylinder wall to retain fuel injector nozzles (not shown). The exhaust port includes at least one circumferential sequence of port openings 125 which alternate with bridges 127. Similarly, the intake port 116 includes a circumferential ring of port openings 128 which alternate with bridges 129. It is typically the case that the openings 125 and bridges 127 of the exhaust port 116 have different shapes and dimensions than the intake port openings and bridges. In these cases, the exhaust port and intake port bridges may not be aligned. Presuming the bore/piston interface is lubricated by transporting oil splashed onto the skirts of the opposed pistons along the bore surface 113, the cylinder embodiment shown in FIG. 3 includes an oil scraper ring 130 seated in the bore, outside of each of the exhaust and intake ports. The scraper rings 130 scrape excess oil off of the skirt surfaces of the exhaust and intake pistons as they slide away from their BDC positions. In other embodiments oil can be provided directly to the bore/piston interface, by pumping through the pistons, for example. In these embodiments excess oil can be removed by piston-mounted rings, by scraper rings, or both.

Three high friction zones are defined for each piston in the bore surface 113 of the ported cylinder 110. In the top reversal zones 132, the pistons reach TDC. As per FIG. 3, the top reversal zones 132 are separated by a middle portion 133 of the bore surface. In the bottom reversal zones 135, the pistons reach BDC. As per FIG. 3, each bottom reversal zone is positioned between a respective port and the corresponding end of the cylinder. Presuming opposed-piston operation, in the third high friction zones (the ports 114 and 116) the rings of each piston cross the bridges of a respective port twice during each cycle of operation. In order to collect and retain oil delivered to a bore/piston interface in the cylinder 110, an oil-retaining surface texture is provided in the interface.

Figure 4A:
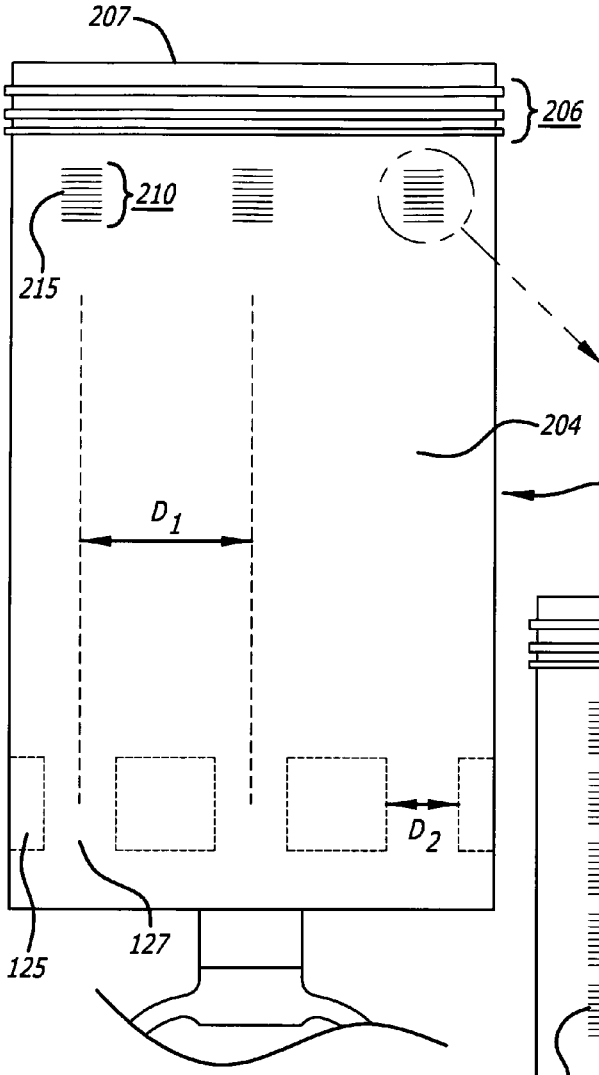
FIGS. 4A through 4D are schematic illustrations of piston skirt texture pattern embodiments.

In FIG. 4A, an oil-retaining surface texture embodiment is provided on a piston 200 including a skirt 204 and a set of rings 206 mounted near and end surface 207 of the piston. For example, presume that the piston 200 slides in the exhaust side of the cylinder 110 of FIG. 3. A representation of a portion of the exhaust port 114 of the cylinder 110 is superimposed on the skirt 204 at a location that would be observed when the piston 200 is at or near TDC. The piston 200 is constructed so as to be received in the bore of a ported cylinder such that the oil-retaining surface texture is aligned with a port in the cylinder. The openings of the exhaust port 114 are represented by the dashed rectangles 125; associated bridges are represented by the spaces 127 between the openings 125. Preferably, the surface texture is composed of one or more texture patterns 210, each comprising a plurality of separate recesses 215 formed in or on the outside surface of the skirt 204, with a first end just inboard of the set of rings 206. Thus, when the piston 200 moves through TDC, oil retained in the recesses of the texture patterns is transported to at least a lower portion of the top reversal zone.

With further reference to FIG. 4A, the texture patterns 210 are disposed in a circumferential area on the outside surface of the skirt 204, separated by the same distance $D_1$ that separates the bridges of the port with which the piston 200 is associated. When the piston 200 is disposed in the bore of the ported cylinder, each texture pattern 210 extends in a longitudinal direction of the cylinder, in alignment with a bridge of the port with which the piston is associated. As a consequence, each texture pattern passes a port over a bridge as the piston slides in the cylinder bore between TDC and BDC. Oil retained in the recesses of the patterns 210 is transported to the bridges as the textured surface portion slides across the bridges. In some aspects, each pattern 210 has a maximum dimension in the circumferential direction of the skirt that is equal to or less than the corresponding circumferential extent $D_2$ of a bridge. That is to say, each texture pattern is no wider than the bridge with which it is aligned. Thus, little, if any, of the oil retained in the textured surface portion reaches the port openings.

As seen in FIG. 3, the bottom reversal zones 135 are outboard of the exhaust and intake ports 114 and 116. During engine operation, opposed pistons sliding in the cylinder 110 traverse the bottom reversal zones continuously. At BDC, the end surfaces of the pistons are positioned between the ports and the associated ends of the cylinder, and so oil retained in the recesses of the patterns 210 seen in FIG. 4A transported to the bottom reversal zones as the patterns 210, slide across the bridges.

The circumferential layout of the patterns 210 on the skirt 204 is not limited to a circumferential sector of any one size. In this regard, the circumferential sector can occupy less than one half of the total surface area of the skirt, as per FIG. 4A, up to one half of the total surface area of the skirt as per FIG. 4B, or more than one half of the total surface area of the skirt as per FIG. 4C.

Figure 4B:
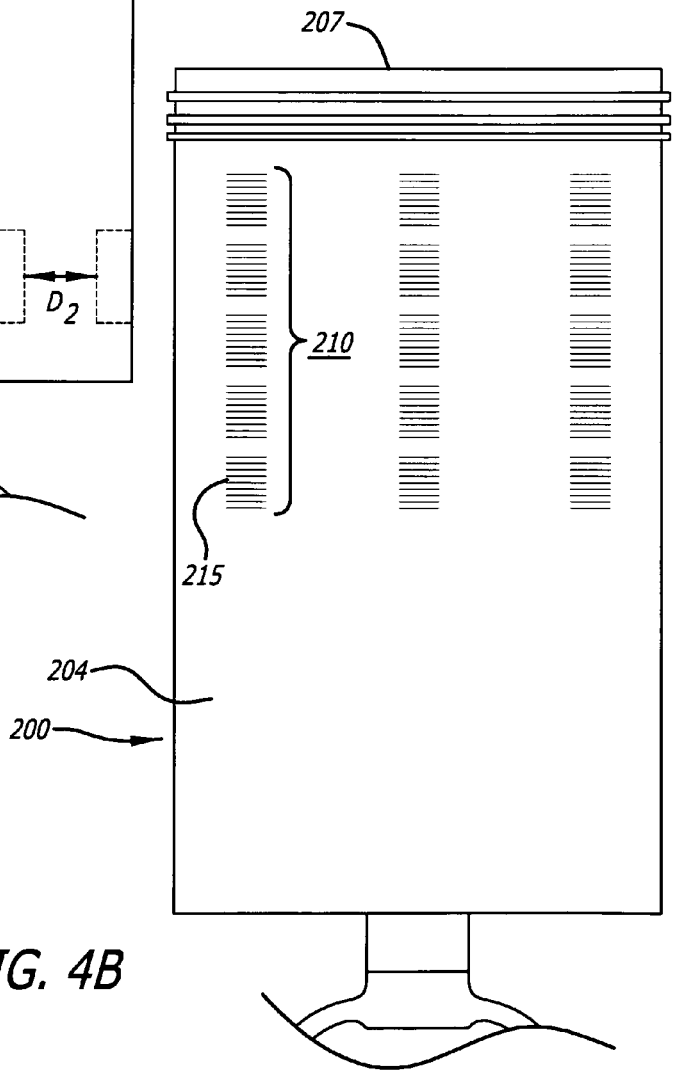
Figure 4C:
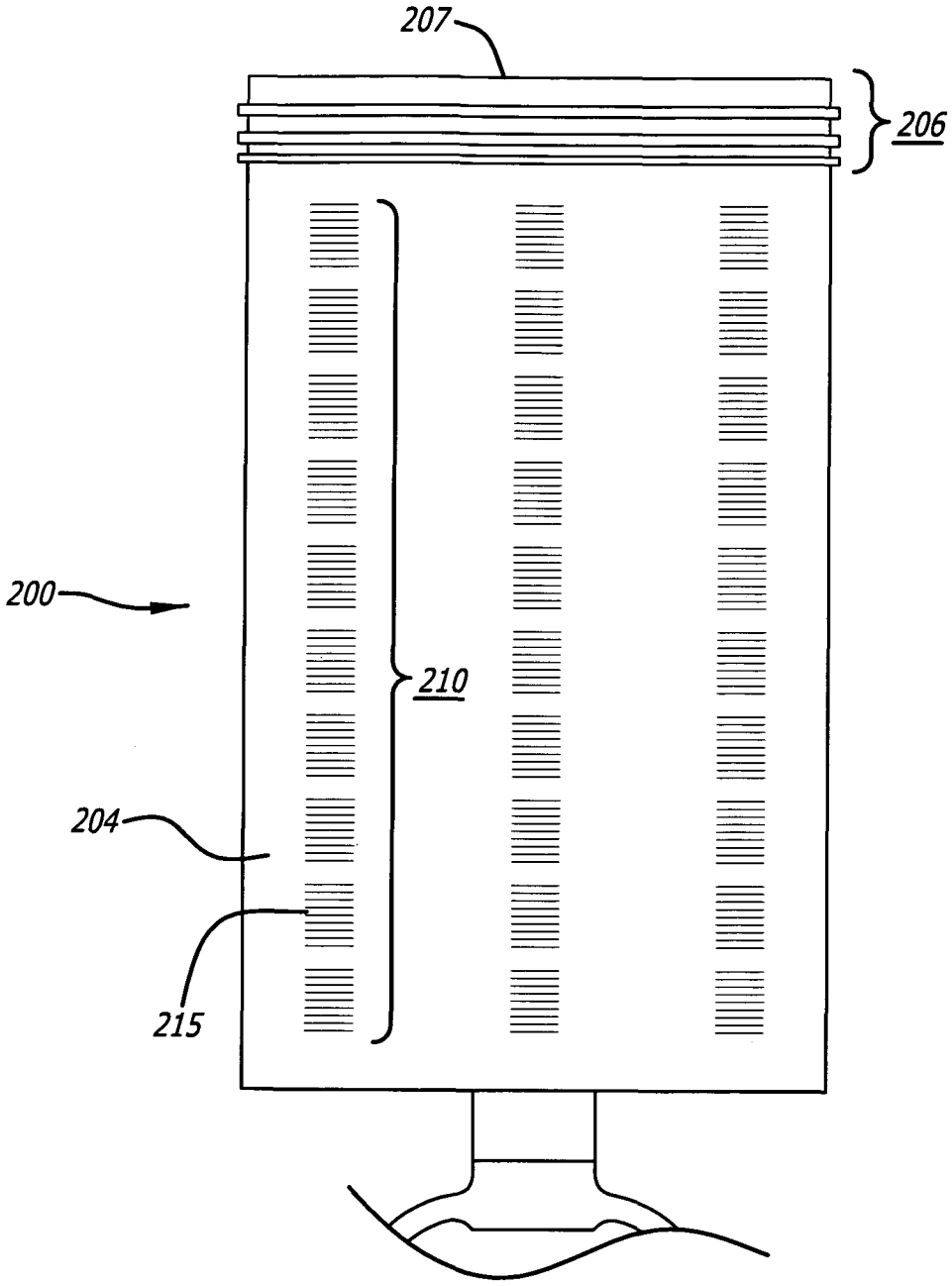
Figure 5A:
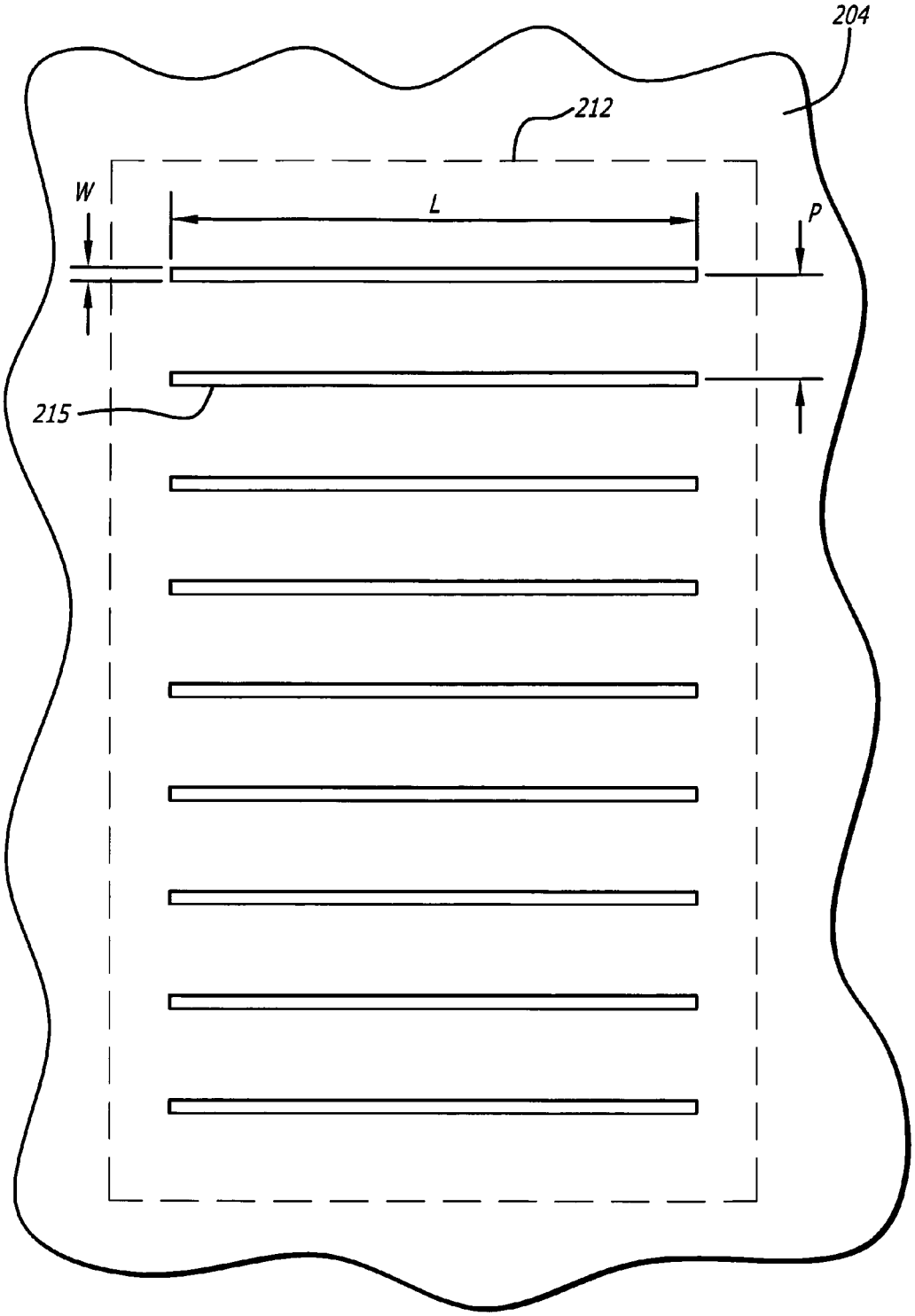
FIGS. 5A and 5B are magnified schematic illustrations of two piston skirt texture pattern embodiments.

The recesses of a surface texture according to this invention are not limited as to construction. The recesses can include any one or more of pits, indentations, scratches, pock marks, depressions, or other equivalent structures. One preferred construction is shown in FIG. 5A, wherein each recess has an elongated slot-like structure. Each texture pattern is constituted of a row 212 of slots 215. Preferably, but not necessarily, the slots of each row are of generally equal length. Longer rows of slots may be partitioned into groups as shown in FIGS. 4B and 4C. Alternately, each of the longer rows of FIGS. 4B and 4C may be constituted of a single, continuous succession of equally-spaced slots.

Referring to FIG. 5A the texture pattern includes a row 212 of separate slots 215. Each slot is 0.07 mm in width (W), 0.01 mm deep, and 5 to 6 mm in length (L). The slots are spaced by a pitch (P) of 1 mm. The slots 215 are formed in the outside surface of the piston skirt by laser ablation of photolithographically-exposed sectors. The spacing and dimensions of the slots are designed to hold a given amount of oil per port bridge area. Increasing the number or sizes of slots enhances lubrication but can increase oil consumption. The tradeoff must take into account such parameters as average engine loads, bore temperatures, and anticipated asperities.

Figure 4D:
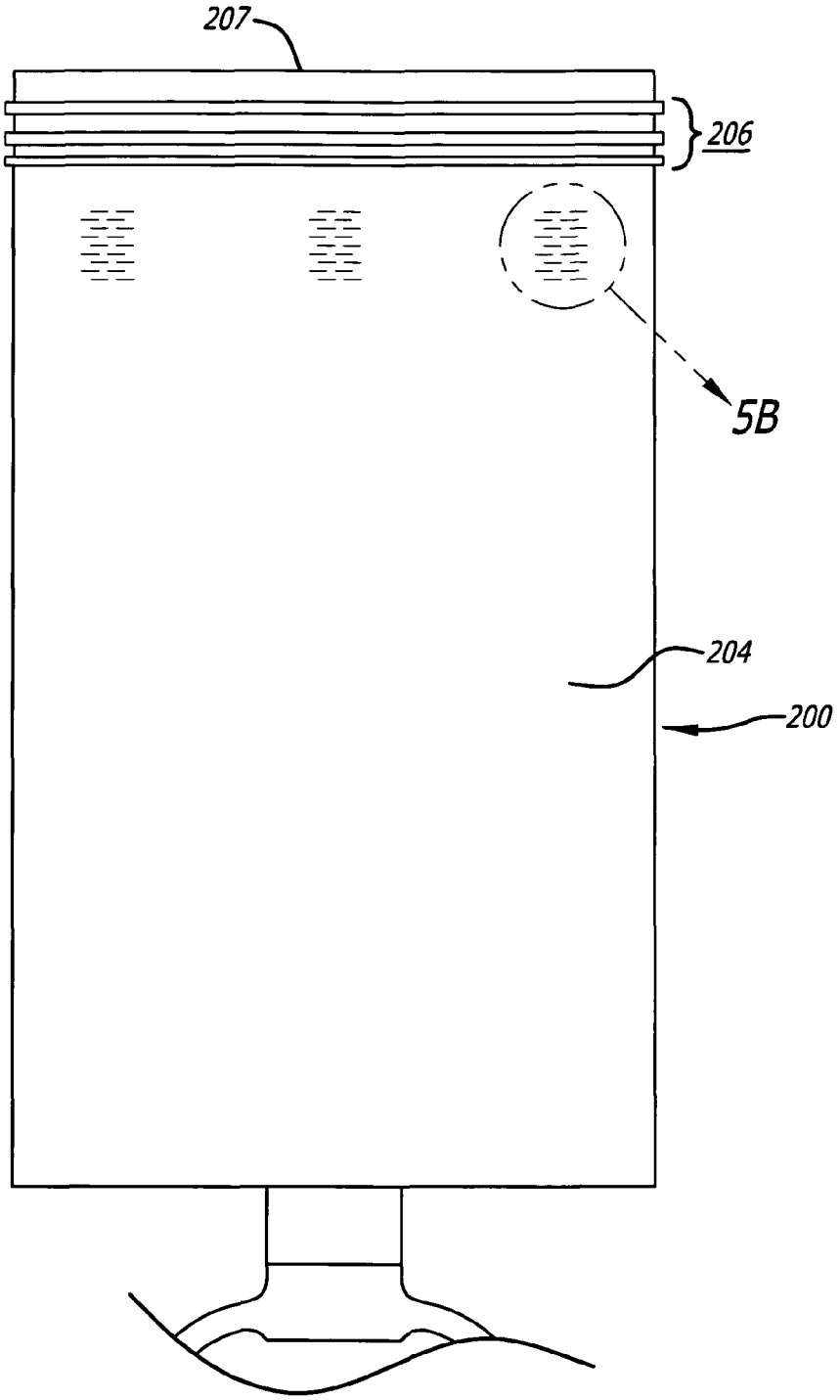
Figure 5B:
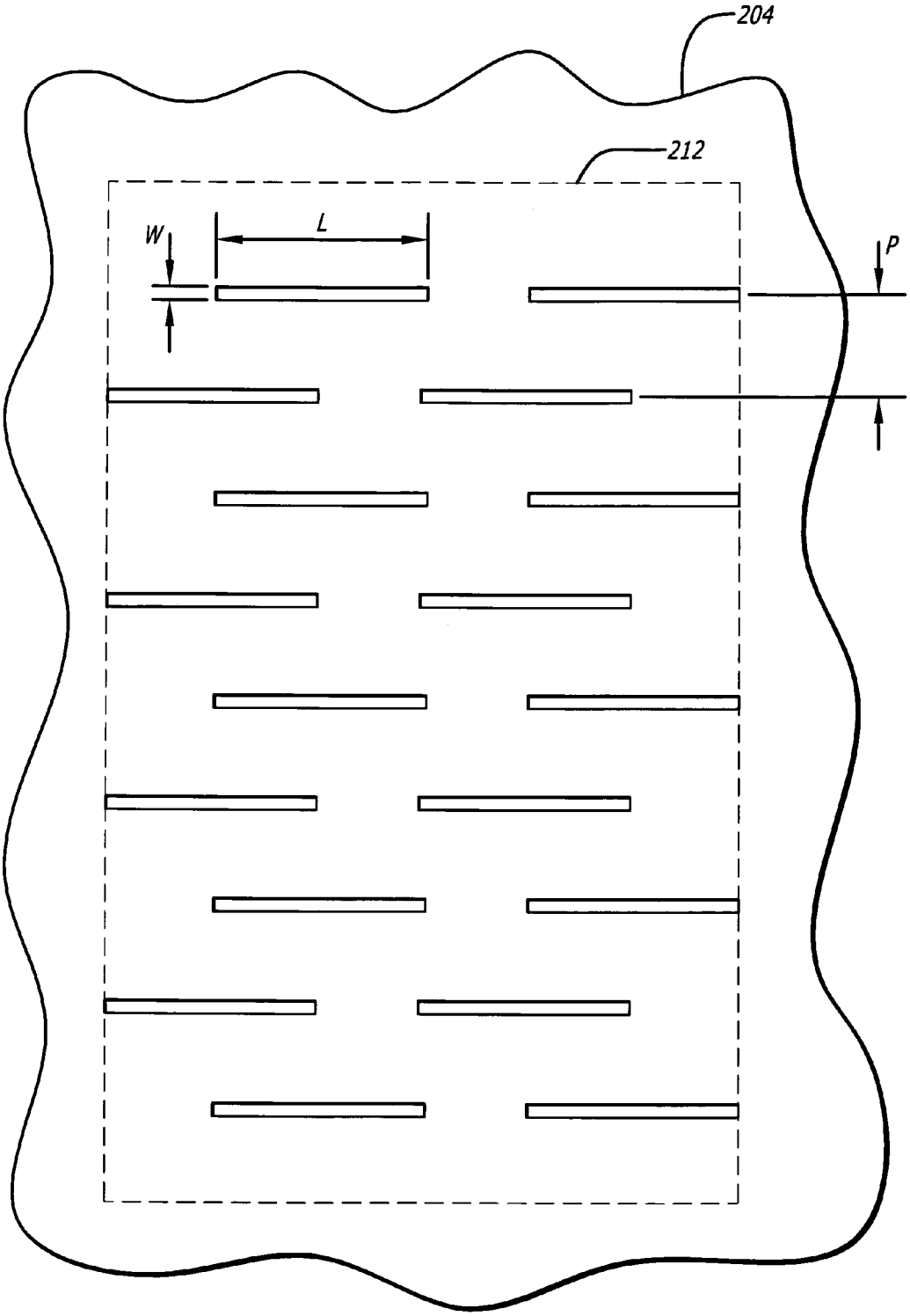

Another oil-retaining surface texture embodiment composed of texture patterns 210 of recesses is seen in FIGS. 4D and 5B where each row 212 is constituted of offset pairs of slots 215. For example, each slot of each pair is 0.07 mm in width (W), 0.010 mm deep, and 2 mm in length (L). Each pair of slots is staggered in a circumferential direction of the skirt 204 with respect to an adjacent pair and the pairs are spaced by a pitch (P) of 1 mm. The patterns 210 are disposed in a circumferential area on the outside surface of the skirt 204, separated by the same distance that separates the bridges of the port with which the piston 200 is associated. When the piston 200 is disposed in the bore of the ported cylinder, each pattern 210 extends in a longitudinal direction of the cylinder, in alignment with a bridge of the port with which the piston is associated. As a consequence, each pattern passes over a port bridge as the piston slides in the cylinder bore between TDC and BDC. Oil retained in the recesses of the patterns 210 is transported to the bridges as the textured surface portion slides across the bridges. In some aspects, each pattern 210 has a maximum dimension in the circumferential direction of the skirt that is equal to or less than the corresponding dimension of a bridge. Thus, little, if any, of the oil retained in the textured surface portion reaches the port openings.

Figure 6:
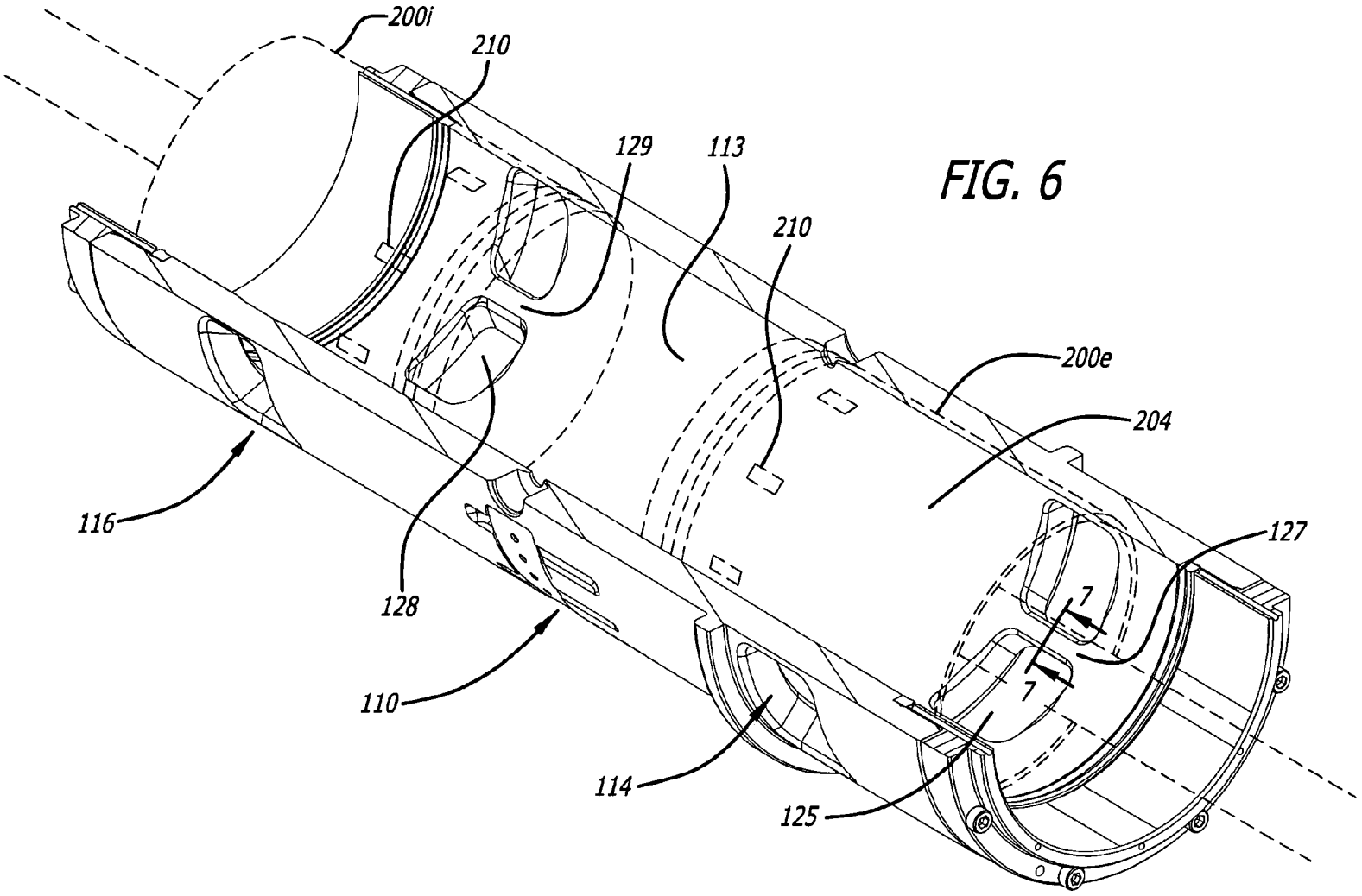
FIG. 6 illustrates the cylinder of FIG. 3 with opposed pistons shadowed therein to identify the relative location of one texture pattern embodiment in relationship to the cylinder port bridges.

Referring now to FIG. 6, wherein opposed pistons 200*e* and 200*i* are disposed in the cylinder 110. One or more textured surface area patterns 210 in or on the outside surface of the skirt 204 of each piston are oriented so as to extend in a longitudinal direction of the cylinder 110, and are circumferentially positioned on the skirt 204 so as to be in alignment with at least one bridge of the port with which the piston is associated. By texturing only areas of the outside surfaces of the skirts 204 that are longitudinally aligned with the port bridges 127 and 129, oil is collected and retained in the three high-friction zones of the bore surface 113 and little or no oil is delivered to the port openings 125 and 128.

Figure 7A:
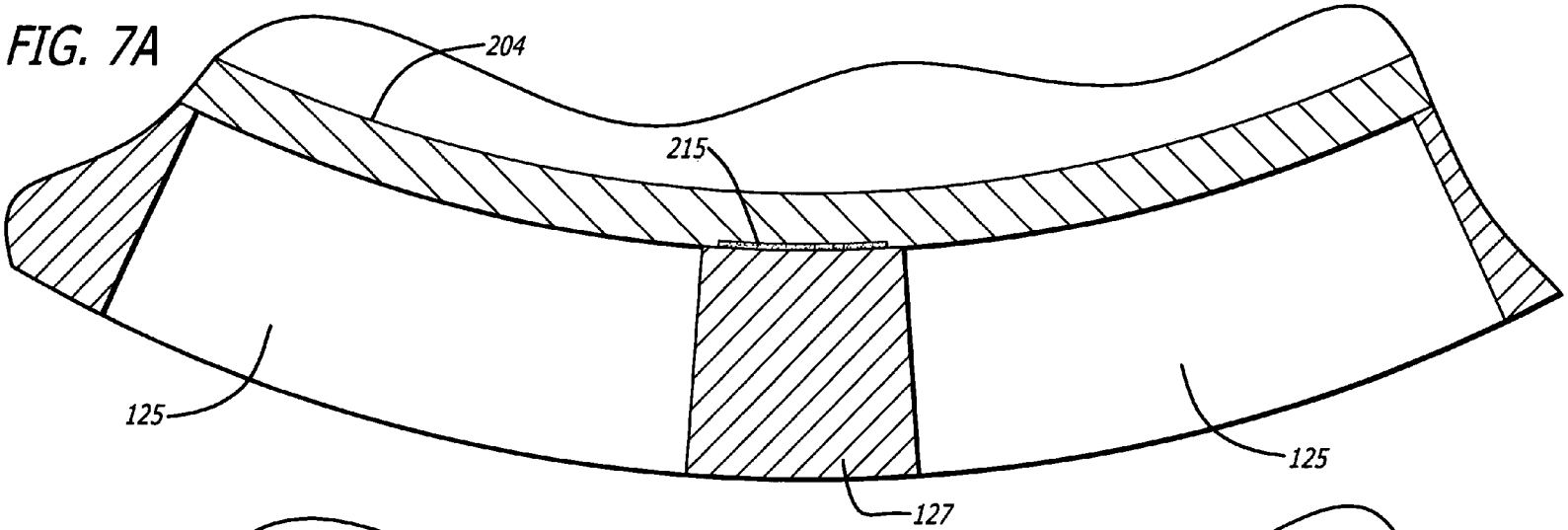
FIGS. 7A and 7B are magnified views of the cross section of the cylinder and the exhaust piston of FIG. 6 at 7-7 showing respective texture pattern embodiments.
Figure 7B:
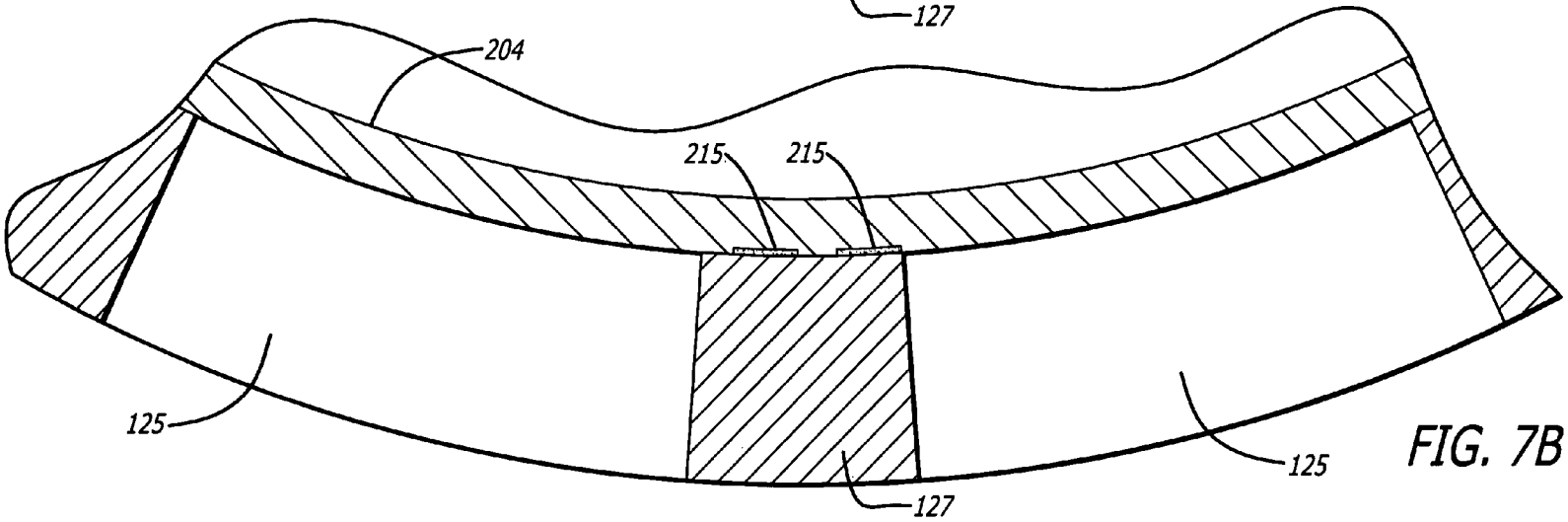

FIGS. 7A and 7B are magnified views of a partial cross-section of the exhaust port 114 and the exhaust piston 200*e* at 7-7 of FIG. 6. In FIG. 7A, a recess 215 of an oil-retaining surface texture pattern according to FIG. 5A is shown in reference to an exhaust port bridge 127. As per the figure, the recess 215 has a maximum dimension in the circumferential direction of the skirt 204 that is equal to or less than the corresponding dimension of the bridge 127. FIG. 7B shows the relationship of a pair of recesses 215 of an oil-retaining texture pattern according to FIG. 5B in reference to the exhaust port bridge 127. As per the figure, the pair of recesses 215 has a maximum dimension in the circumferential direction of the skirt that is equal to or less than the corresponding dimension of the bridge 127.

Figure 7C:
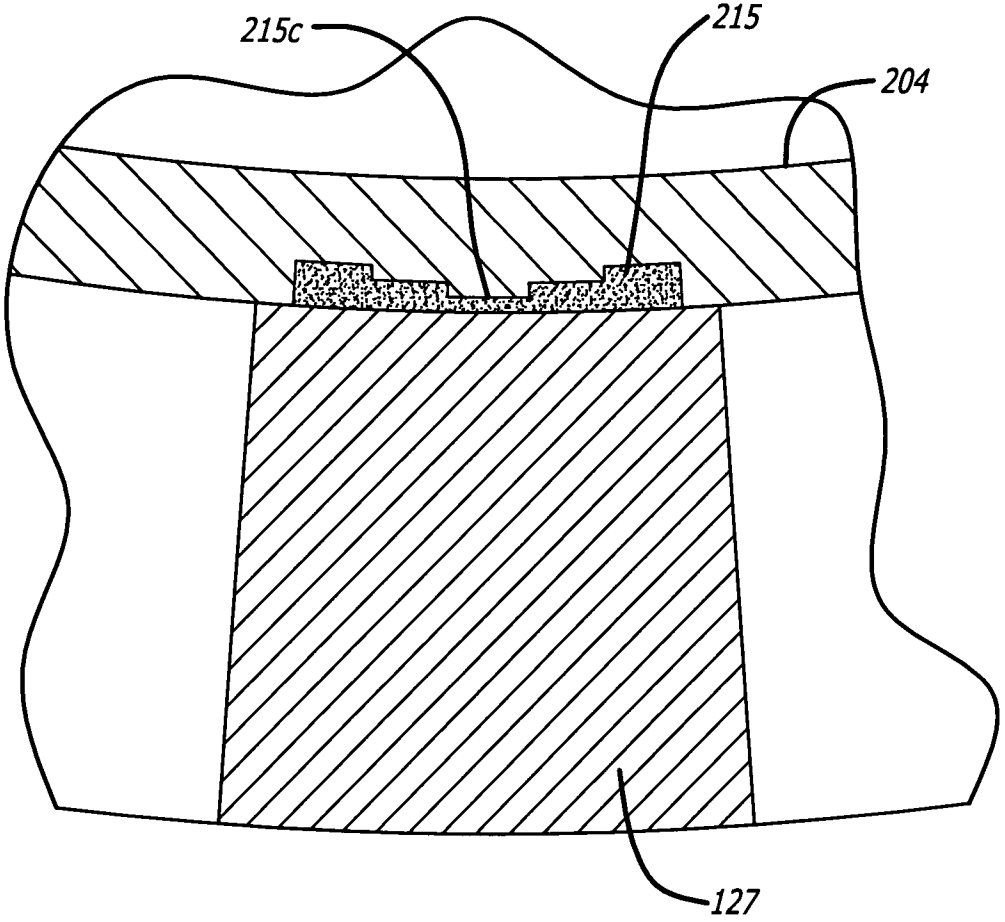
FIG. 7C is a magnified view of the cross section of the cylinder and the exhaust piston of FIG. 6 at 7-7 showing a texture pattern recess embodiment.

FIG. 7C is a magnified view of a partial cross-section of the exhaust port 114 and the exhaust piston 200*e* at 7-7 of FIG. 6. In FIG. 7C, a recess 215 of an oil-retaining surface texture pattern on the piston skirt 204 is shown in reference to the exhaust port bridge 127. As per the figure, the recess 215 has a maximum dimension in the circumferential direction of the skirt 204 that is equal to or less than the corresponding dimension of the bridge 127. The recess also has a cross-sectional configuration that varies stepwise in depth in opposing circumferential directions of the skirt 204 from a central portion 215*c*. With reference to FIG. 6, as the piston 200*e* slides in the bore of the cylinder 110, the piston skirt 204 is scraped by the oil scraper 130. In time, the engagement with the oil scraper 130 wears at least the lower portion of the skirt's outer surface. Friction is reduced and less lubrication is needed. As per FIG. 7C, as the outer surface of the piston skirt 204 wears, at least one step-wise decrease in the amount of oil retained in the recess 215 occurs when the surface of the central portion 215*c* contacts the bore surface. Each step wise decrease in the amount of oil is accompanied by a step increase in the contact surface area between the skirt and bore surfaces, which increases the total lubricated are in the bore/piston interface.

Figure 8:
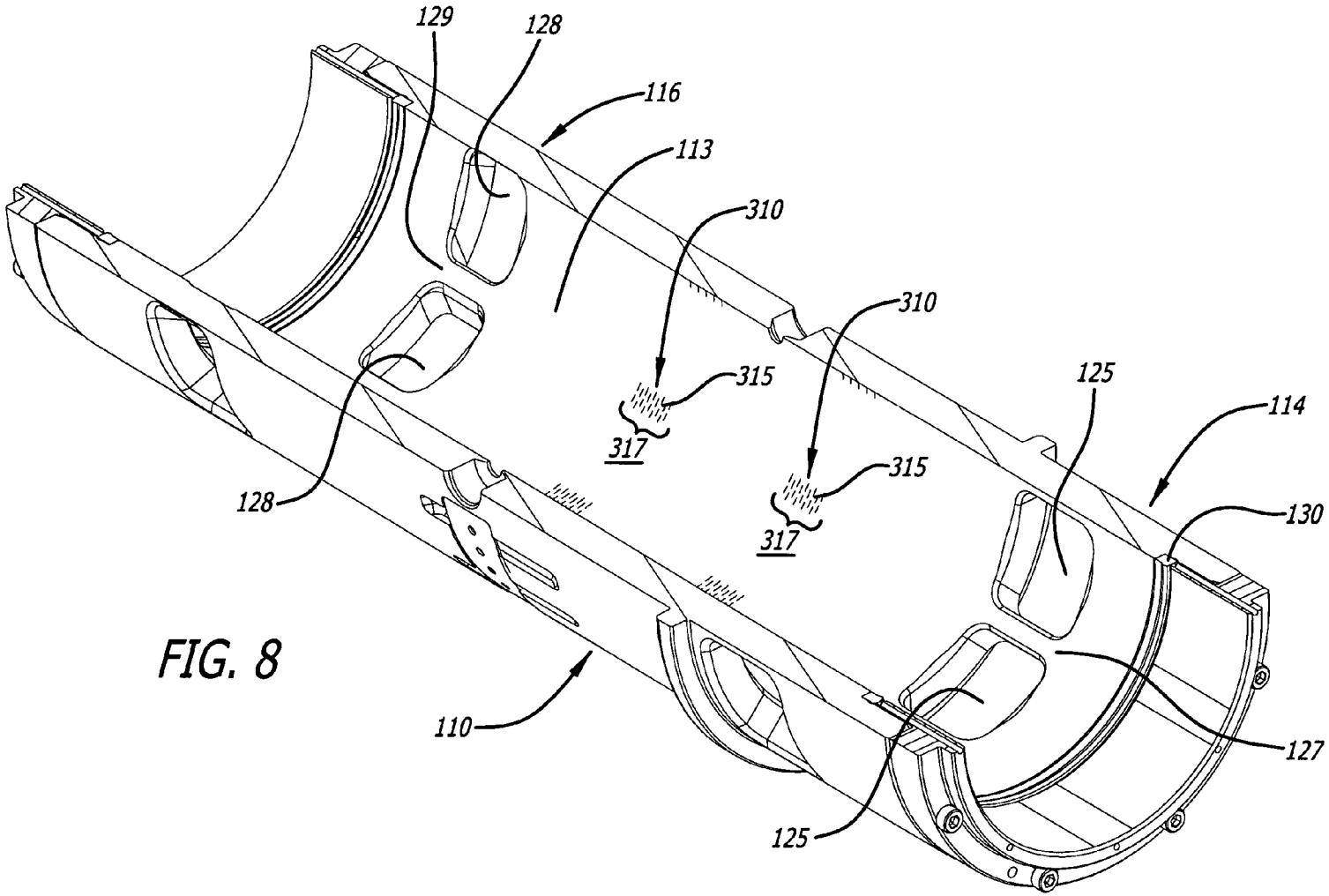
FIG. 8 illustrates the cylinder of FIG. 3 with texture patterns on the bore.

Referring to FIG. 8, it is also within the scope of the invention to provide an oil-retaining surface texture on or in the bore surface 113 of the cylinder 110. As the figure shows, an oil-retaining surface texture is composed of texture patterns 310 with pluralities of separate recesses 315 on or in the bore surface 113 that collect and retain oil to lubricate the interface between opposed pistons and the bore surface 113. As is the case with the patterns on the pistons seen in FIGS. 4A-4D, the patterns 310 on or in the bore surface 113 extend in a longitudinal direction of the cylinder 110, and are aligned with bridges of at least one of the ports 114 and 116. Preferably, the patterns 310 on the exhaust side of the bore surface 113 are aligned with the bridges of the exhaust port 114, and the patterns 310 on the intake side of the bore surface 113 are aligned with the bridges of the intake port 116. The patterns 310 shown in FIG. 8 are positioned in the top reversal zones of the bore surface 113, although this is not meant to so limit the invention. Texture patterns can also be provided on the port bridges 127 and 129 and in the bottom reversal zones of the cylinder 110. An embodiment of bore-surface texture patterns includes rows 317 of slots, or rows 317 of pairs of slots 315. In some aspects, each pattern 310 has a maximum dimension in the circumferential direction of the bore that is equal to or less than the corresponding dimension of a bridge. In other words, each texture pattern is no wider than the bridge with which it is aligned.

It is also within the scope of the invention to provide oil-retaining surface texture patterns on either or both of a pair of opposed pistons disposed to slide in the bore of a ported cylinder while also providing oil-retaining surface texture patterns on or in the bore surface of the cylinder.

With reference to the figures, a method of lubricating an opposed piston engine having at least one cylinder 110 with a bore surface 113 and longitudinally-spaced exhaust and intake ports 114 and 116, and a pair of opposed pistons 200*e* and 200*i* disposed in the cylinder for sliding movement along the bore surface, includes retaining oil in a surface texture pattern 210 and/or 310 in the interface between the pistons and the bore surface that extends in a longitudinal direction of the cylinder, aligned with the bridges of at least one of the exhaust and intake ports. Oil in the surface texture patterns is transported by sliding the pistons on the bore surface.

With reference to the figures, an opposed-piston engine includes at least one cylinder 110 with a bore surface 113 and longitudinally-spaced exhaust and intake ports 114 and 116 near respective ends of the cylinder, and a pair of opposed pistons 200*e* and 200*i* disposed in the cylinder for sliding movement along the bore surface. A method of operating the engine includes retaining oil in a first row 217, 317 of separate recesses 215, 315 in an interface between an exhaust piston 200*e* and the bore surface 113 that extends in a longitudinal direction of the cylinder, between respective top dead center (TDC) and bottom dead center (BDC) reversal zones 132 and 135 of the exhaust piston 200*e* and aligned with a bridge 127 of the exhaust port 114, and retaining oil in a second row 217, 317 of recesses 215, 315 in an interface between an intake piston 200*i* and the bore surface 113 that extends in a longitudinal direction of the cylinder, between respective TDC and BDC reversal zones 132 and 135 of the intake piston and aligned with a bridge 129 of the intake port 116.

In practice, a cylinder conforming to this detailed description may be constituted of a suitable metal, such as aluminum, aluminum alloy, steel or iron. Such a cylinder can be cast in a monolithic cylinder block or can be constituted of a liner. The bore surface may be bare, or it may be coated with a layer of material. In any event, it is desirable that the bore surface be composed of a material, in which texture patterns of recesses can be formed by a known process such as machining, peening, laser or acid ablation, or photolithography.

A piston conforming to this detailed description may be constituted of a suitable metal such as aluminum or an aluminum alloy. The outer surface of the piston's skirt can be coated with a layer of metal or metal alloy. It is desirable that the outer skirt surface be composed of a material in which texture patterns of recesses can be formed by a known process such as machining, peening, laser or acid ablation, or photolithography.

Although the invention has been described with reference to a number of described embodiments, it should be understood that various modifications can be made without departing from the spirit of the invention. Accordingly, the invention is limited only by the following claims.

The invention claimed is:

1. An opposed piston engine having at least one cylinder with a bore surface and longitudinally-spaced exhaust and intake ports, and a pair of opposed pistons disposed in the cylinder for sliding movement along the bore surface, in which an oil-retaining surface texture pattern in an interface between the pistons and the bore surface extends in a longitudinal direction of the cylinder between a top ring reversal zone where the sliding velocity of a ring mounted to a piston reaches zero when the piston is near a top dead center position and a bottom ring reversal zone where the sliding velocity of the ring reaches zero when the piston is near a bottom dead center position, and in which the surface texture pattern comprises at least one row of separate recesses on the bore surface aligned with a bridge of at least one port.

2. The opposed piston engine of claim 1, in which an end portion of the at least one row is positioned in a reversal zone of the bore surface.

3. The opposed piston engine of claim 1, in which the at least one row is no wider than a the bridge with which it is aligned.

4. The opposed piston engine of claim 1, in which the reversal zone is positioned near the middle area of the bore surface.

5. A cylinder mechanism including a cylinder with a bore surface and longitudinally-spaced exhaust and intake ports near respective ends and a pair of opposed pistons disposed in the cylinder for sliding movement along the bore surface, in which a first oil-collecting surface texture pattern in an interface between an exhaust piston and the bore surface extends in a longitudinal direction of the cylinder, between respective top dead center (TDC) and bottom dead center (BDC) reversal zones of the exhaust piston and aligned with a bridge of the exhaust port, and a second oil-collecting surface texture pattern in an interface between an intake piston and the bore surface extends in a longitudinal direction of the cylinder, between respective TDC and BDC reversal zones of the intake piston and aligned with a bridge of the intake port.

6. The cylinder mechanism of claim 5, in which the first surface texture pattern includes at least one row of separate recesses on an outside surface of a skirt of the exhaust piston, each row extending in a longitudinal direction of the exhaust piston, and the second surface texture includes at least one row of separate recesses on an outside surface of a skirt of the intake piston, each row extending in a longitudinal direction of the intake piston.

7. The cylinder mechanism of claim 6, in which each texture pattern is no wider than a bridge with which it is aligned.

8. The cylinder mechanism of claim 7, in which each row includes a first end near a piston ring location.

9. The cylinder mechanism of claim 6, in which the surface texture pattern includes a plurality of rows of separate recesses in an outside surface of a skirt of each piston, and for the exhaust piston, each row extends in a longitudinal direction of the exhaust piston and is disposed at a circumferential location of the piston skirt that corresponds to a location of a bridge of the exhaust port, and for the intake piston, each row extends in a longitudinal direction of the intake piston and is disposed at a circumferential location of the piston skirt that corresponds to a location of a bridge of the intake port.

10. The cylinder mechanism of claim 9, in which each row includes a first end near a piston ring location.

11. The cylinder mechanism of claim 9, in which each recess of a plurality of the recesses has a cross-sectional configuration that varies stepwise in depth in opposing circumferential directions of a skirt from a central portion of the recess.

12. The cylinder mechanism of claim 5, in which the surface texture pattern includes at least two rows of separate recesses on the bore surface, a first row extending from the exhaust piston TDC reversal zone toward the exhaust port, and a second row extending from the intake piston TDC reversal zone toward the intake port.

13. The cylinder mechanism of claim 12, in which the exhaust piston TDC reversal zone and the TDC intake piston reversal zone are separated by the middle area of the bore surface.

14. A method of lubricating an opposed piston engine having at least one cylinder with a bore surface and longitudinally-spaced exhaust and intake ports, and a pair of opposed pistons disposed in the cylinder for sliding movement along the bore surface, by transporting oil into the bore on surfaces of the pistons, and retaining the oil in a surface texture pattern in the bore surface that extends in a longitudinal direction of the cylinder, between respective top dead center and bottom dead center reversal zones of at least one of the opposed pistons.

15. The method of claim 14, in which retaining oil in a surface texture pattern includes retaining the oil in at least one row of separate recesses on an outside surface of a skirt of each piston that extends in a longitudinal direction of the piston in alignment with at least one bridge of at least one port.

16. The method of claim 14, in which retaining oil in a surface texture pattern includes retaining the oil in at least one row of separate recesses on the bore surface in alignment with at least one bridge of at least one port.

17. A method of operating an opposed-piston engine including at least one cylinder with a bore surface and longitudinally-spaced exhaust and intake ports near respective ends and a pair of opposed pistons disposed in the cylinder for sliding movement along the bore surface, by retaining oil in a first row of recesses in an interface between an exhaust piston and the bore surface that extends in a longitudinal direction of the cylinder, between respective top dead center (TDC) and bottom dead center (BDC) reversal zones of the exhaust piston and aligned with a bridge of the exhaust port, and retaining oil in a second row of recesses in an interface between an intake piston and the bore surface that extends in a longitudinal direction of the cylinder, between respective TDC and BDC reversal zones of the intake piston and aligned with a bridge of the intake port.

18. The method of claim 17, in which retaining oil in a first row of recesses includes retaining oil in at least one row of recesses on a skirt surface of the exhaust piston, and retaining oil in a second row of recesses includes retaining oil in at least one row of recesses on a skirt surface of the intake piston.

19. The method of claim 17, in which retaining oil in a first row of recesses includes retaining oil in at least one row of recesses on a bore surface of the cylinder extending toward the exhaust port, and retaining oil in a second row of recesses includes retaining oil in at least one row of recesses on a bore surface of the cylinder extending toward the intake port.

* * * * *